US011149400B2

(12) United States Patent
Wang et al.

(10) Patent No.: US 11,149,400 B2
(45) Date of Patent: Oct. 19, 2021

(54) THIN-SLOTTING LIFTING SYNCHRONOUS GROUTING DEVICE AND ITS USAGE METHOD

(71) Applicants: Infrastructure Renewal Institute of Southern China, Guangdong (CN); WELEAD Infrastructure Engineering Technology (Zhengzhou), Ltd., Henan (CN)

(72) Inventors: Fuming Wang, Guangdong (CN); Hongyuan Fang, Guangdong (CN); Peng Zhao, Henan (CN); Yanhui Pan, Henan (CN); Xianfeng Zhao, Henan (CN); Yingli Wang, Henan (CN)

(73) Assignees: Infrastructure Renewal Institute of Southern China, Guangdong (CN); WELEAD Infrastructure Engineering Technology (Zhengzhou), Ltd., Henan (CN)

( * ) Notice: Subject to any disclaimer, the term of this patent is extended or adjusted under 35 U.S.C. 154(b) by 0 days.

(21) Appl. No.: 16/858,744

(22) Filed: Apr. 27, 2020

(65) Prior Publication Data

US 2020/0256031 A1 Aug. 13, 2020

(30) Foreign Application Priority Data

Aug. 30, 2019 (CN) ..... 201910818543.7

(51) Int. Cl.
*E02D 15/04* (2006.01)
*E02D 3/12* (2006.01)

(52) U.S. Cl.
CPC ..... *E02D 15/04* (2013.01); *E02D 3/12* (2013.01); *E02D 2250/003* (2013.01)

(58) Field of Classification Search
CPC ..... E02D 3/12; E02D 15/04; E02D 2250/003; E02D 19/06
USPC ..... 405/232, 242
See application file for complete search history.

(56) References Cited

U.S. PATENT DOCUMENTS 3,540,225 A * 11/1970 Muller ..... E02D 5/50 405/242
4,664,560 A * 5/1987 Cortlever ..... E02D 5/03 405/129.8
4,886,400 A * 12/1989 Taki ..... E02D 3/126 405/267
4,909,674 A * 3/1990 Konno ..... E02D 19/18 405/266

(Continued)

*Primary Examiner* — Benjamin F Fiorello

(57) ABSTRACT

A thin-slotting lifting synchronous grouting device and its usage method are provided. The device includes a hollow force-bearing column through which a feeding pipe passes; wherein: left and right cutting plates are respectively fixedly arranged on each side of the hollow force-bearing column; a left connecting plate is fixedly arranged on an outside of the left cutting plate; a right guiding column is fixedly arranged on an outside of the right cutting plate; center lines of the left connecting plate, the right guiding column and the hollow force-bearing column are in a same plane; a top end of to the feeding pipe is connected to a grouting device, and a bottom end is connected to a spraying device; a spraying nozzle of the spraying device stretches out along the hollow force-bearing column; and a lower end of the hollow force-bearing column is connected with a disposable conical head.

8 Claims, 1 Drawing Sheet

(56) References Cited

U.S. PATENT DOCUMENTS

| | | | | | |
|---|---|---|---|---|---|
| 5,256,004 | A * | 10/1993 | Gemmi | E02D 5/34 | 405/237 |
| 5,304,016 | A * | 4/1994 | Kunito | E02D 5/46 | 405/233 |
| 5,836,390 | A * | 11/1998 | Apps | C09K 17/38 | 166/281 |
| 5,967,700 | A * | 10/1999 | Gunther | E02D 3/12 | 405/226 |
| 9,133,596 | B2 * | 9/2015 | Carter, Jr. | E02D 19/16 | |
| 2011/0103898 | A1 * | 5/2011 | Wang | E02D 3/12 | 405/266 |
| 2011/0103899 | A1 * | 5/2011 | Wang | E02D 19/16 | 405/270 |
| 2014/0314494 | A1 * | 10/2014 | Wang | E02D 17/13 | 405/229 |
| 2014/0314498 | A1 * | 10/2014 | Wang | E02D 15/04 | 405/266 |
| 2017/0370065 | A1 * | 12/2017 | Song | E02D 5/48 | |
| 2019/0048550 | A1 * | 2/2019 | Borel | E02D 3/12 | |

* cited by examiner

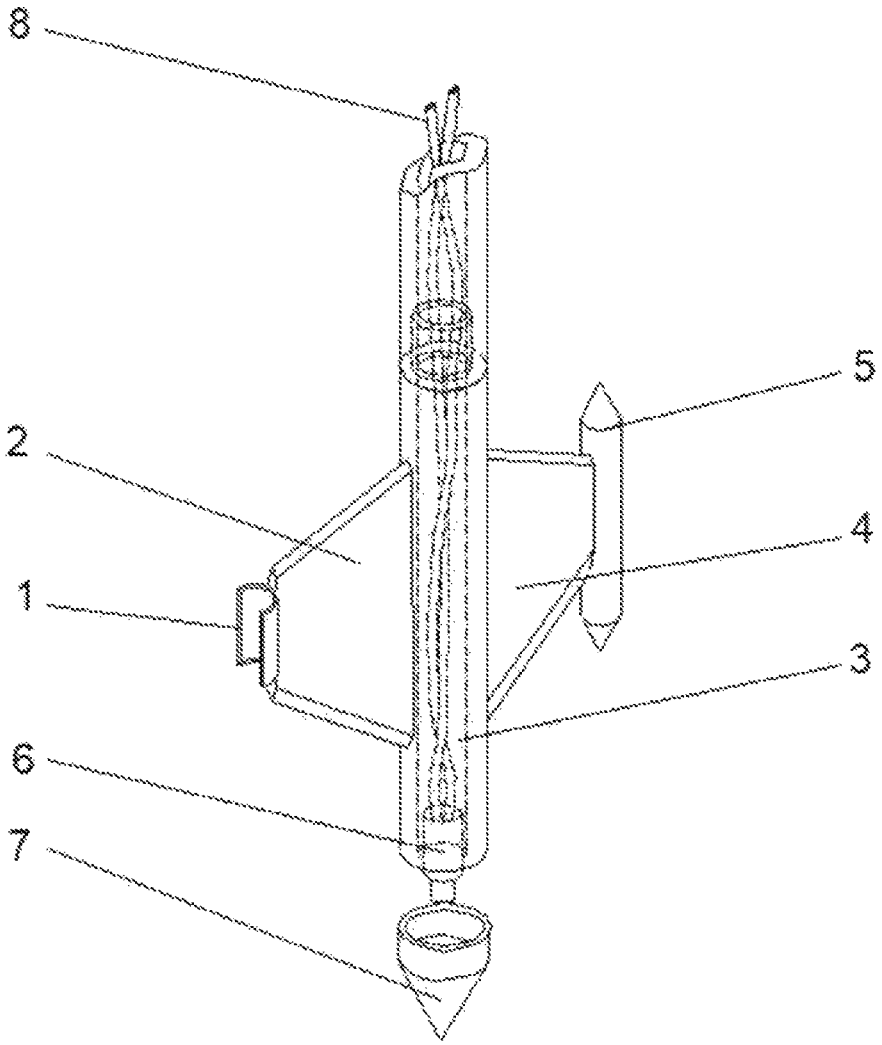
8
5
2
4
1
3
6
7

THIN-SLOTTING LIFTING SYNCHRONOUS GROUTING DEVICE AND ITS USAGE METHOD

CROSS REFERENCE OF RELATED APPLICATION

The application claims priority under 35 U.S.C. 119(a-d) to CN 201910818543.7, filed Aug. 30, 2019.

BACKGROUND OF THE PRESENT INVENTION

Field of Invention

The present invention relates to a technical field of slotting and spraying for constructing an anti-seepage layer at various infrastructures such as soil embankments, waste landfills, buildings, and more particularly to a thin-slotting lifting synchronous grouting device and its usage method.

Description of Related Arts

In China, the embankment projects of rivers, lakes and seas reach a length of tens of thousands of kilometers. The embankments have the flood control and disaster prevention effects and they play an important role in guaranteeing the safety of the flood control works in China. The strong embankments work as barriers that keep the flood at the outer side to avoid the damages of the flood to the life and property safety of the nearby residents. Limited by the previous economic and technical conditions, the design and construction of a large amount of embankments have inherent deficiencies. After a long period of operation and disrepair, these embankments are seriously aging and have the prominent seepage problem; particularly, the soil embankments are threatened by different seepage hazards.

Besides, with the rapid growth of economy in China, a large amount of municipal solid wastes are generated, and therefore, a lot of money is invested for the construction of the waste landfills. In China, the simple waste dumping sites and the landfill sites are the two most common types of waste landfills. Compared with the simple waste dumping sites, the landfill sites are less polluting, and thus have become an emerging way to dispose the solid wastes. Due to the non-standard preliminary design and construction, most of the landfill sites are not adequately impermeable that a lot of landfill leachate without any processing will directly penetrate into the soil and underground water, resulting in serious pollutions to the environment. Although some waste landfills are equipped with the pollutant-interception dam, the vertical anti-seepage in the soil is often ignored, so that the landfill leachate may bypass the pollutant-interception dam and seep into the soil from the dam foundation. Thus, the vertical anti-seepage treatment of the landfill sites is particularly important.

In conclusion, the seepage prevention is a key problem for the soil embankments and the waste landfills, to solve which, currently, the cement soil mixing pile technology, the concrete anti-seepage wall technology and the high-pressure jet grouting technology have been widely used to build the anti-seepage walls in actual engineering. However, these technologies have some technical shortcomings. To be specific, the conventional anti-seepage wall building technologies are to form the impervious body in soil through slotting, stirring, spraying and vibrating independently, which has great disturbance and damage to the embankments, and they have a long construction period, and they are expensive and inconvenient. Especially for the small embankments, the current technologies are useless because it is difficult to place the relevant equipment on the construction sites as the equipment is always too large in their size. To overcome these shortcomings, the development of the thin-slotting grouting integrated device is required and necessary.

SUMMARY OF THE PRESENT INVENTION

To overcome the shortcomings mentioned above, a thin-slotting lifting synchronous grouting device and its usage method are provided in this invention. The present invention combines slotting with grouting and it has a small disturbance to soil mass. The device suffers less friction. Compared with the traditional anti-seepage technologies, the technology presented in this invention consumes a less amount of impermeable raw materials, which greatly lowers the construction cost. Moreover, the present invention provides the matched equipment and construction technology for the thin anti-seepage walls, and it is able to be applied in the thin-slotting of various projects, showing great economic and social benefits and wide development and application prospects.

In order to accomplish above object, the present invention adopts technical solutions as follows.

The provided thin-slotting lifting synchronous grouting device comprises a hollow force-bearing column through which a feeding pipe passes; a left cutting plate and a right cutting plate are respectively fixedly arranged on each side of the hollow force-bearing column along an axial direction thereof; a left connecting plate socketing with a first drill pipe is fixedly arranged on an outside of the left cutting plate; a right guiding column is fixedly arranged on an outside of the right cutting plate; center lines of the left connecting plate, the right guiding column and the hollow force-bearing column are in a same plane; a top end of the feeding pipe is connected to a grouting device; a bottom end of the feeding pipe is connected to a spraying device; a spraying nozzle of the spraying device stretches out along the hollow force-bearing column; and a lower end of the hollow force-bearing column is connected with a disposable conical head.

Preferably, a cross section of the left connecting plate is C-shaped, and an opening direction of the C-shaped plate is away from the left cutting plate.

Preferably, both the left cutting plate and the right cutting plate are isosceles trapezoidal; side edges of the trapezoidal cutting plates work as cutting blades; and bottoms of the trapezoidal cutting plates are fixedly arranged on the hollow force-bearing column.

Further preferably, an included angle between waists and a lower base of each trapezoidal cutting plate is in a range of 40-60°.

Preferably, a middle part of the right guiding column is cylindrical, and two ends of the right guiding column are conical.

Preferably, a distance from a far left side of the left connecting plate to a far right side of the right guiding column is in a range of 500-1000 mm.

Preferably, for the hollow force-bearing column, an outer diameter and an inner diameter are 60-90 mm and 20-70 mm, respectively; the left connecting plate is with a thickness of 16-25 mm and a height of 100-250 mm; a diameter of the middle part of the right guiding column is 50-70 mm, and an overall height of the right guiding column is 400-600 mm; and a thickness of both the left cutting plate and the right cutting plate is 20-50 mm.

Preferably, the left connecting plate, the hollow force-bearing column, the left cutting plate, the right cutting plate and the right guiding column are integrated.

The usage method of the mentioned thin-slotting lifting synchronous grouting device comprises steps of:

(1) according to a design drawing, successively arranging the left connecting plate, the hollow force-bearing column, the left cutting plate, the right cutting plate and the right guiding column; wherein an axial section of the hollow force-bearing column should be in a same plane as a plane of a designed anti-seepage wall;

(2) on a construction site, passing the feeding pipe through the hollow force-bearing column from top to bottom; connecting the top end of the feeding pipe to the grouting device, and connecting the bottom end of the feeding pipe to the spraying device; connecting the disposable conical head to a bottom end of the hollow force-bearing column; wherein a top end of the hollow force-bearing column is connected to a second drill pipe on a pressing machine;

(3) checking and confirming whether the center lines of the hollow force-bearing column, the left connecting plate and the right guiding column are all in the same plane;

(4) on one side of the anti-seepage wall that will be constructed, pressing the first drill pipe of which a diameter is matched with the left connecting plate into soil mass to a predetermined depth;

(5) putting the left connecting plate on the first drill pipe that has been pressed into the soil mass, and then pressing the entire thin-slotting lifting synchronous grouting device into the soil mass to a predetermined depth by using the pressing machine;

(6) lifting up the thin-slotting lifting synchronous grouting device by using a winch, so that the disposable conical head will fall off;

(7) starting the grouting device while lifting the thin-slotting lifting synchronous grouting device to make the spraying device start to work; wherein: during a lifting process, a thin anti-seepage wall will gradually form.

Compared with the prior technologies, the present invention has the advantages as follows.

Firstly, the slotting process and grouting process are integrated in the present invention. After slotting, when lifting up the device provided by the present invention, the disposable conical head will fall off and then the grouting device is started for grouting, through which the continuous, uniform and regular thin anti-seepage wall will be built.

Secondly, the technology presented in this invention is cost-saving. Since the cutting plates are thin and they are with a thickness of 20-50 mm, the formed slots are with the same thickness. Compared with the traditional anti-seepage wall constructing technologies, the present invention consumes a less amount of impermeable materials, which can greatly lower the construction cost.

Thirdly, the technology presented in this invention brings little disturbance to the soil mass. Due to the thin cutting plates, the friction force of the device against the soil mass is small, and thus the soil mass is little disturbed. The slotting process is convenient and fast. The technology presented in invention adopts the dry construction method and no slurry is needed for preventing the walls from deformation, and thus it has little influence on the surrounding environment.

BRIEF DESCRIPTION OF THE DRAWINGS

The FIGURE is a structural sketch view of a thin-slotting lifting synchronous grouting device according to a preferred embodiment of the present invention.

In this FIGURE, the number 1 represents a left connecting plate; the number 2 represents a left cutting plate; the number 3 represents a hollow force-bearing column; the number 4 represents a right cutting plate; the number 5 represents a right guiding column; the number 6 represents a spraying device; the number 7 represents a disposable conical head; and the number 8 represents a feeding pipe.

DETAILED DESCRIPTION OF THE PREFERRED EMBODIMENT

As shown in the FIGURE, the thin-slotting lifting synchronous grouting device provided in this invention comprises a hollow force-beating column 3, through which a feeding pipe 8 passes; a left cutting plate 2 and a right cutting plate 4 are respectively fixedly arranged on each side of the hollow force-bearing column 3 along the axial direction thereof; a left connecting plate 1 socketing with a first drill pipe is fixedly arranged on the outside of the left cutting plate 2; a right guiding column 5 is fixedly arranged on the outside of the tight cutting plate 4; the center lines of the left connecting plate 1, the right guiding column 5 and the hollow force-bearing column 3 are in a same plane; the top end of the feeding pipe 8 is connected to a grouting device; the bottom end of the feeding pipe 8 is connected to a spraying device 6; a spraying nozzle of the spraying device 6 stretches out along the hollow force-bearing column 3; and the lower end of the hollow force-hearing column 3 is connected with a disposable conical head 7 in a socket connection way. The grouting device can be a slurry transfer pump or a liquid storage tank, and it is an integrated polymer grouting device which feeds the slurry to the feeding pipe 8. The spraying device 6 comprises the spraying nozzle for spraying the slurry. Both of the grouting device and the spraying device are mature technologies and thus no more details are presented here. During the constructing process, the device used for pressing the entire thin-slotting lifting synchronous grouting device into the soil mass is a pressing machine that is very available and thus no more details are presented here.

Furthermore, the cross section of the left connecting plate 1 is C-shaped, and the opening direction of the C-shaped plate is away from the left cutting plate 2, which is convenient for being socked with the first drill pipe and for departing from the first drill pipe, and easy to use.

Furthermore, for quick slotting as well as saving the grouting material, both the left cutting plate 2 and the right cutting plate 4 are trapezoidal; the side edges of the trapezoidal cutting plates work as cutting blades; and the bottom of each trapezoidal cutting plate is fixedly arranged on the hollow force-bearing column 3.

Furthermore, for slotting quickly, the included angle between the waists and the lower base of each trapezoidal cutting plate is in the range of 40-60°.

Furthermore, the middle part of the right guiding column 5 is cylindrical, and the two ends of the right guiding column 5 are conical.

Furthermore, the distance from the far left side of the left connecting plate 1 to the far right side of the right guiding column 5 is in the range of 500-1000 mm.

Furthermore, for the hollow force-bearing column 3, the outer diameter and the inner diameter are 60-90 mm and 20-70 mm, respectively; the left connecting plate 1 is with thickness of 16-25 mm and height of 100-250 mm; the diameter of the middle part of the right guiding column 5 is 50-70 mm, and the overall height of the right guiding column is 400-600 mm; and thickness of both the left cutting plate 2 and right cutting plate 4 is 20-50 mm.

Furthermore, the left connecting plate 1, the hollow force-bearing column 3, the left cutting plate 2, the right cutting plate 4 and the right guiding column 5 are integrated for the stable slotting. The above mentioned components can also be arranged independently.

The present invention further provides a usage method of the thin-slotting lifting synchronous grouting device, comprising steps of:

(1) according to a design drawing, successively arranging the left connecting plate 1, the hollow force-bearing column 3, the left cutting plate 2, the right cutting plate 4 and the right guiding column 5; wherein the axial section of the hollow force-bearing column 3 should be in the same plane as the plane of the designed anti-seepage wall;

(2) on the construction site, passing the feeding pipe 8 through the hollow force-bearing column 3 from top to bottom; connecting the top end of the feeding pipe 8 to the grouting device, and connecting the bottom end of the feeding pipe 8 to the spraying device 6; connecting the disposable conical head 7 to the bottom end of the hollow force-bearing column 3; wherein a top end of the hollow force-bearing column 3 is connected to a second drill pipe on a pressing machine;

(3) checking and confirming whether the center lines of the hollow force-bearing column 3, the left connecting plate 1 and the right guiding column 5 are all in the same plane;

(4) on one side of the anti-seepage wall that will be constructed, pressing the first drill pipe of which a diameter is matched with the left connecting plate 1 into the soil mass to a predetermined depth;

(5) putting the left connecting plate 1 on the first drill pipe that has been pressed into the soil mass, and then pressing the entire thin-slotting lifting synchronous grouting device into the soil mass to the predetermined depth by using the pressing machine;

(6) lifting up the thin-slotting lifting synchronous grouting device by using a winch, so that the disposable conical head 7 will fall off; (7) starting the grouting device while lifting the thin-slotting lifting synchronous grouting device to make the spraying device 6 start to work; wherein: during the lifting process, a thin anti-seepage wall will gradually form.

The above embodiment is merely a preferred embodiment of the present invention. It should be noted that for one skilled in this field, various modifications and improvements can be made without departing from the overall concept of the present invention, which should be all included in the protection scope of the present invention and will not influence the implementation effects and patent utility of the present invention.

What is claimed is:

1. A thin-slotting lifting synchronous grouting device, comprising a hollow force-bearing column (3) through which a feeding pipe (8) passes; wherein: a left cutting plate (2) and a right cutting plate (4) are respectively fixedly arranged on each side of the hollow force-bearing column (3) along an axial direction thereof; a left connecting plate (1) socketing with a first drill pipe is fixedly arranged on an outside of the left cutting plate (2); a cross section of the left connecting plate (1) is C-shaped, and an opening direction of the C-shaped plate is away from the left cutting plate (2); a right guiding column (5) is fixedly arranged on an outside of the right cutting plate (4); center lines of the left connecting plate (1), the right guiding column (5) and the hollow force-bearing column (3) are in a same plane; a top end of the feeding pipe (8) is connected to a grouting device; a bottom end of the feeding pipe (8) is connected to a spraying device (6); a spraying nozzle of the spraying device (6) stretches out along the hollow force-bearing column (3); and a lower end of the hollow force-bearing column (3) is connected with a disposable conical head (7).

2. The thin-slotting lifting synchronous grouting device, as recited in claim 1, wherein: both the left cutting plate (2) and the right cutting plate (4) are isosceles trapezoidal; side edges of the trapezoidal cutting plates work as cutting blades; and bottoms of the trapezoidal cutting plates are fixedly arranged on the hollow force-bearing column (3).

3. The thin-slotting lifting synchronous grouting device, as recited in claim 2, wherein: an included angle between waists and a lower base of each trapezoidal cutting plate is in a range of 40-60°.

4. The thin-slotting lifting synchronous grouting device, as recited in claim 2, wherein: a middle part of the right guiding column (5) is cylindrical, and two ends of the right guiding column are conical.

5. The thin-slotting lifting synchronous grouting device, as recited in claim 1, wherein: a distance from a far left side of the left connecting plate (1) to a far right side of the right guiding column (5) is in a range of 500-1000 mm.

6. The thin-slotting lifting synchronous grouting device, as recited in claim 1, wherein: for the hollow force-bearing column (3), an outer diameter and an inner diameter are 60-90 mm and 20-70 mm, respectively; the left connecting plate (1) is with a thickness of 16-25 mm and a height of 100-250 mm; a diameter of a middle part of the right guiding column (5) is 50-70 mm, and an overall height of the right guiding column is 400-600 mm; and a thickness of both the left cutting plate (2) and the right cutting plate (4) is 20-50 mm.

7. The thin-slotting lifting synchronous grouting device, as recited in claim 1, wherein: the left connecting plate (1), the hollow force-bearing column (3), the left cutting plate (2), the right cutting plate (4) and the right guiding column (5) are integrated.

8. A usage method of the thin-slotting lifting synchronous grouting device as recited in claim 1, comprising steps of:

(1) according to a design drawing, successively arranging the left connecting plate (1), the hollow force-bearing column (3), the left cutting plate (2), the right cutting plate (4) and the right guiding column (5); wherein an axial section of the hollow force-bearing column (3) should be in a same plane as a plane of a designed anti-seepage wall;

(2) on a construction site, passing the feeding pipe (8) through the hollow force-bearing column (3) from top to bottom; connecting the top end of the feeding pipe (8) to the grouting device, and connecting the bottom end of the feeding pipe (8) to the spraying device (6); connecting the disposable conical head (7) to a bottom end of the hollow force-bearing column (3); wherein a top end of the hollow force-bearing column (3) is connected to a second drill pipe on a pressing machine;

(3) checking and confirming whether the center lines of the hollow force-bearing column (3), the left connecting plate (1) and the right guiding column (5) are all in the same plane;

(4) on one side of the anti-seepage wall that will be constructed, pressing the first drill pipe of which a diameter is matched with the left connecting plate (1) into soil mass to a predetermined depth;

(5) putting the left connecting plate (1) on the first drill pipe that has been pressed into the soil mass, and then pressing the entire thin-slotting lifting synchronous grouting device into the soil mass to a predetermined depth by using the pressing machine;

(6) lifting up the thin-slotting lifting synchronous grouting device by using a winch, so that the disposable conical head (7) will fall off;

(7) starting the grouting device while lifting the thin-slotting lifting synchronous grouting device to make the spraying device (6) start to work; wherein: during a lifting process, a thin anti-seepage wall will gradually form.

* * * * *